US007851390B2

(12) United States Patent
Salzmann et al.

(10) Patent No.: US 7,851,390 B2
(45) Date of Patent: Dec. 14, 2010

(54) TWO-DIMENSIONAL TEXTILE MATERIAL, ESPECIALLY TEXTILE FABRIC, HAVING SHRINK PROPERTIES AND PRODUCTS MANUFACTURED THEREFROM

(75) Inventors: Oliver Salzmann, Willich (DE); Till W. H. d'Alquen, Mönchengladbach (DE); Hans-Richard Essers, Wassenberg (DE)

(73) Assignee: K&R Textil GmbH & Co. KG, Monchengladbach (DE)

( * ) Notice: Subject to any disclaimer, the term of this patent is extended or adjusted under 35 U.S.C. 154(b) by 386 days.

(21) Appl. No.: 12/021,797

(22) Filed: Jan. 29, 2008

(65) Prior Publication Data

US 2009/0081409 A1 Mar. 26, 2009

(30) Foreign Application Priority Data

| | | |
|---|---|---|
| Sep. 21, 2007 | (DE) | 10 2007 045 411 |
| Oct. 12, 2007 | (DE) | 10 2007 049 247 |
| Oct. 19, 2007 | (DE) | 10 2007 050 489 |

(51) Int. Cl.
*D03D 15/04* (2006.01)
*D03D 15/08* (2006.01)

(52) U.S. Cl. ..... 442/303; 442/2; 442/37; 442/182; 442/301

(58) Field of Classification Search ..... 442/301, 442/303, 2, 37, 182
See application file for complete search history.

(56) References Cited

U.S. PATENT DOCUMENTS

| | | | | |
|---|---|---|---|---|
| 3,552,691 | A * | 1/1971 | Haller | 245/10 |
| 4,388,801 | A | 6/1983 | D'Alquen | 57/12 |
| 5,700,881 | A * | 12/1997 | Wagner et al. | 525/440.05 |

FOREIGN PATENT DOCUMENTS

| | | | |
|---|---|---|---|
| DE | 1 875 997 | U | 7/1963 |
| DE | 1 959 320 | A | 6/1971 |
| DE | 3 247 651 | A1 | 8/1984 |
| DE | 200 18 190 | U1 | 2/2001 |
| EP | 0 036 948 | A1 | 10/1981 |
| EP | 0 056 667 | A1 | 7/1982 |

* cited by examiner

*Primary Examiner*—Andrew T Piziali
(74) *Attorney, Agent, or Firm*—Woodard, Emhardt, Moriarty, McNett & Henry LLP

(57) ABSTRACT

A heat-shrinkable planar textile material with a plurality of yarn systems forming the planar textile material, wherein the planar textile material having at least one heat-shrinkable plastic yarn. The planar textile material is suitable for producing furniture elements, especially seating furniture elements, preferably backrests and/or seat elements, decorative elements, hollow channels, automotive accessories, and the like, wherein the heat-shrinkable planar textile material can be mounted on a carrier structure and then heat shrunk.

8 Claims, 2 Drawing Sheets

TWO-DIMENSIONAL TEXTILE MATERIAL, ESPECIALLY TEXTILE FABRIC, HAVING SHRINK PROPERTIES AND PRODUCTS MANUFACTURED THEREFROM

CROSS REFERENCES TO RELATED APPLICATIONS

This application claims priority to German Patent Application No. DE 10 2007 045 411.4, filed Sep. 21, 2007, and also claims priority to German Patent Application No. DE 10 2007 049 247.4, filed Oct. 12, 2007, and also claims priority to German Patent Application No. DE 2007 050 489.8, filed Oct. 19, 2007, entitled "TWO-DIMENSIONAL TEXTILE MATERIAL, ESPECIALLY TEXTILE FABRIC, HAVING SHRINK PROPERTIES AND PRODUCTS MANUFACTURED THEREFROM". All three references are expressly incorporated by reference herein, in their entirety.

BACKGROUND OF THE DISCLOSURE

The present disclosure relates to a two-dimensional or planar textile material, especially a textile fabric, with shrinkage properties, especially heat-shrinkage properties, according to the disclosure. The title refers to a "two-dimensional" textile material and by ignoring a fabric thickness, this description is used interchangeably with "planar". Furthermore, the present disclosure relates to a heat-shrunk planar textile material, which is constructed similarly, in particular, in the form of a textile fabric and from which heat-shrinkable, planar textile material according to the disclosure is produced. The heat-shrinkable, planar textile material is suitable for use for producing a heat-shrunk, planar textile material. The heat-shrinkable planar textile material according to the disclosure can also be used in one method for producing the heat-shrunk planar textile material. In addition, the heat-shrinkable planar textile material is suitable for use in the field of the furniture industry, the automotive industry, and the like. In addition, the present disclosure relates to a method for producing furniture elements, decorative elements, hollow channels, automotive accessories, and the like under the use of heat-shrinkable planar textile material. Finally, the present disclosure relates to the elements or components produced in this way.

Strict requirements are placed on planar textile materials used, for example, in the field of the furniture industry as covering materials or as linings for carrier or frame structures, for example, for seating furniture or the like, and which manages in this respect without cushioning or support. For example, it is necessary that planar textile materials used for the previously mentioned purposes provide high stability in order to be able to carry appropriate loads, wherein it is similarly necessary that the planar textile materials provide, in addition to the previously mentioned strength properties, a certain degree of flexibility or elasticity, in order to guarantee appropriate comfort or ergonomics for seating furniture. Here, it is also necessary that the planar textile material returns to its original state again after a corresponding force-related loading, that is, it provides expansion recovery properties. In other words, such planar textile materials must provide sufficiently high reversible expandability, in order to prevent irreversible bulging under loss of stress. In addition, it is necessary that the planar textile materials, especially textile fabric, provide sufficient non-slip properties (slip resistance), especially seam non-slip properties, in order to prevent shifting of the corresponding warp and weft threads when a load is placed on the material. Planar textile materials of the state of the art, however, are not always in the position to satisfy the previously mentioned requirements in a satisfactory way.

Furthermore, in the state of the art it is problematic to produce fold-free coverings or linings, for example, of carrier devices in the form of frames, which are used, in particular, for chairs, for example, as the back or sitting piece. This is because, in the state of the art, the problem often arises that especially in the area of fixing the planar textile material on the carrier or frame, folds or the like are formed, which, however, is undesirable. To minimize this disadvantage in the state of the art, it is provided in this respect to realize the most exact possible sewing or the most exact possible blank of the planar textile material, which, however, is complicated and cost-intensive in terms of production. In addition, planar materials of the state of the art exhibit only a limited flexibility or shaping freedom with respect to the shaping of coverings or linings of carrier or frames. For complex shapes, a fold is often formed in the area of contours, narrow sections, arcs, or the like in the carrier or frame.

To guarantee internal stress of the covering or the lining, it is also necessary in the state of the art to place the planar textile material already under tension onto the carrier, which is unfavorable in terms of production.

In view of this background of the technology, a task of the present disclosure is to prepare a planar textile material that at least largely avoids or at least lessens the previously mentioned disadvantages of the state of the art. In particular, such a textile planar structure should be constructed or equipped such that, in this way, especially fold-free coverings of frame constructions, especially for chairs or the like, are enabled and the planar textile material simultaneously features good reversible expansion properties and a high loading capacity.

The previously mentioned task is achieved within the scope of the present disclosure, according to a first aspect, through a heat-shrinkable planar textile material with a plurality of yarn systems forming the planar material according to the disclosure. Additional advantageous constructions of the planar textile material according to the disclosure, which is present in particular in the form of a heat-shrinkable textile fabric, are the subject matter of the subordinate claims in this respect.

Another subject matter of the present disclosure is, according to a second aspect, the heat-shrinkable planar textile material which can be obtained through heat treatment of the planar textile material according to the disclosure. Other advantageous constructions of the heat-shrinkable planar textile material are the subject matter of the disclosure, claims, and drawings.

In addition, the subject matter of the present disclosure, according to a third aspect, is the method for producing furniture elements, especially seating furniture elements, decorative elements, hollow channels, automotive accessories, and the like under the use of the planar textile material according to the disclosure.

Finally, the subject matter of the present disclosure, according to a fourth aspect, includes furniture elements, especially seating furniture elements, hollow channels, automotive accessories, and the like according to the disclosure, with these elements featuring the planar textile material according to the disclosure.

It is understood that constructions, embodiments, advantages, and the like, which are discussed below only with respect to one aspect of the disclosure for the purpose of avoiding repetition, obviously also apply with respect to the other aspects disclosed herein.

The subject matter of the present disclosure, according to a first aspect, is thus a planar textile material with a plurality of yarn systems forming the planar textile material, wherein the planar textile material features at least one heat-shrinkable plastic yarn.

The planar textile material is distinguished in that it is itself heat-shrinkable or features heat-shrinking properties through the specific use of a heat-shrinkable plastic yarn (also called synonymously "heat-shrinkable synthetic yarn"). Due to its properties, the heat-shrinkable textile material is suitable for a plurality of applications. In this respect, the textile material according to the disclosure can be used, for example, in the field of the furniture industry, especially for the production of seating furniture or the like, but also in the automotive industry, wherein the planar textile material according to the disclosure is suitable, in particular, for covering carrier elements or devices, such as carrier frames or the like, wherein, due to the excellent force-related loading capacity of the planar textile material according to the disclosure, support structures, such as foam cushions or the like, are not necessary and the planar textile material can be so-to-speak stretched onto a carrier structure to a certain extent directly without additional stabilizing measures. However, later or subsequent cushioning, for example, is nevertheless not excluded.

Here, a serious advantage of the present disclosure is to be seen in that the heat-shrinkable planar textile material according to the disclosure, which is preferably a fabric, especially as mentioned below, can be placed or fixed so-to-speak directly onto a carrier structure, for example, a frame, without requiring in this respect an exact blank or exact sewing. This is because, through the heat shrinking performed preferably after application onto a carrier structure, due to the heat-shrinking properties, the planar textile material according to the disclosure is, to a certain extent, pulled smooth and mounted or set under (internal) tension, so that an essentially fold-free covering or a fold-free lining is produced. Through the heat-shrinking process, a certain internal tension of the planar textile material according to the disclosure applied to a carrier structure is also established, so that, due to the biasing, a high force-related load capacity is produced, without which the planar textile material according to the disclosure will expand excessively or bulge excessively.

Due to the optimized reversible expandability of the planar textile material according to the disclosure, it is similarly guaranteed that the planar textile material according to the disclosure, which is placed in heat-shrunk form on a carrier device, for example, a sitting surface of a chair or the like, can adapt ergonomically to body contours when it is being used, so that high comfort and excellent ergonomics are produced.

Another advantage of the planar textile material according to the disclosure is to be seen in that, after a force-related loading, which is associated with expansion or bulging of the planar textile material according to the disclosure, the planar textile material according to the disclosure returns to a certain extent back to its original shape due to the high recovery force. Simultaneously, the planar textile material according to the disclosure features excellent expansion recovery properties. These expansion recovery properties are emphasized or reinforced especially through, if necessary, elastomeric or rubber threads, yarns, filaments, or the like; therefore, it is preferred, according to the disclosure, when the planar textile material according to the disclosure also has an elastomeric and/or rubber portion (e.g., rubber, natural rubber, elastomeric polymers, etc.), preferably in the form of elastomeric or rubber threads, yarns, filaments, or the like, wherein their percentage with respect to the planar textile material according to the disclosure can equal overall at least 5 wt %, advantageously at least 10 wt %, especially preferred at least 20 wt %.

Another advantage of the planar textile material according to the disclosure is to be seen in that high flexibility with respect to the carrier structure to be covered or lined is produced due to the heat-shrinking properties, wherein greatly pronounced contours, such as narrow sections, arcs, bends, and the like can be covered or lined effectively while avoiding the excessive formation of folds.

The planar textile material according to the disclosure can exist in numerous constructions: for example, it is possible to form the planar textile material as fabric, knit fabric, stitched fabric, structure, or textile composite, for example, non-woven fabric. According to one especially preferred embodiment of the disclosure, the planar textile material is constructed in the form of a textile fabric.

In this respect, in the scope of the present disclosure, the term "fabric" is understood to involve preferably a planar structure made from warp and weft threads, with the fabric being able to be constructed under the use of specific weaves or registers known to those skilled in the art.

The term "yarn," as understood in the scope of the present disclosure, represents a collective term for all linear textile structures. In this connection, a yarn can have one or more fibers or threads. The heat-shrinkable plastic yarn used according to the disclosure preferably involves filament yarn, which, considered theoretically, involves threads of endless length to some extent.

According to the disclosure, the term "heat-shrinkable" is understood to be a change in dimension induced due to the effect of heat, wherein this is associated with a reduction in length with respect to the heat-shrinkable plastic yarn, wherein, with respect to the heat-shrinkable plastic yarn, a thickening, i.e., an increase in diameter, of the plastic yarn can result to a certain extent. The heat shrinking involves, in the scope of the present disclosure, a controlled reduction in dimension of the plastic yarn and, thus, of the planar textile material according to the disclosure, wherein the reduction in length with respect to the planar textile material takes place in the direction of the heat-shrinkable plastic thread. The shrinking taking place according to the disclosure involves, in particular, an essentially irreversible shrinking process.

The heat-shrinkable plastic yarn used in the scope of the present disclosure can involve a monofilament or a multifilament. With respect to the construction of the heat-shrinkable plastic yarn as a multifilament, it is similarly possible to combine the heat-shrinking components of the plastic yarn with other, non-shrinking components, such as other fibers or threads, especially as defined below. In this way, the heat-shrinkable plastic yarn used according to the disclosure can also be constructed as a staple fiber yarn (wherein, in this case, the heat-shrinkable staple fiber yarn is constructed from actual heat-shrinkable plastic yarn components and also one or more other non-heat-shrinkable yarn components). With respect to the non-heat-shrinking yarns that can also be used, like those that can be used for the yarn system and like those that are defined in more detail below, so-called staple fiber yarns can also be used, which include fibers of finite length.

If the heat-shrinkable plastic yarn is used with other fibers or threads, here it can also involve a so-called covered yarn, in which the plastic yarn acts to a certain extent as a "core" and thus is visually essentially invisible or it involves a so-called twisted yarn.

Furthermore, as far as the heat-shrinkable plastic yarn is concerned, for example, with respect to the shrinking behavior, especially good results are produced when the plastic yarn has a polyester based on phthalate. According to the disclosure, it can be provided that the plastic yarn has or consists of polyethylene terephthalate, polypropylene terephthalate, polybutylene terephthalate, preferably polyethylene terephthalate.

According to the disclosure, the monofilament type 940R produced by the company Teijin Ltd., Japan, can be used, for example.

Furthermore, as far as the heat-shrinkable plastic yarn is concerned, this can feature, in the non-shrunk state, a diameter of 0.05-1 mm, especially 0.1-0.8 mm, advantageously 0.15-0.6 mm, preferred 0.2-0.4 mm. Here, it is to be taken into consideration that during the heat shrinking, a thickening of the fibers can be produced with shortening of the length, so that the planar textile material according to the disclosure features shrunk plastic yarns in the shrunk state, which can feature an increased diameter relative to the non-shrunk state.

The parameters specified below relate, in particular, to a heat-shrinkable plastic yarn which features a diameter of 0.05-1 mm, especially 0.1-0.8 mm, advantageously 0.15-0.6 mm, preferred 0.2-0.4 mm.

The heat-shrinkable plastic yarn can feature titer of 100-3000 dtex, especially 500-2500 dtex, advantageously 1000-2250 dtex, preferred 1500-2000 dtex.

Furthermore, the heat-shrinkable plastic yarn should have a tenacity of 10-120 cN/tex, especially 20-100 cN/tex, advantageously 30-80 cN/tex, preferred 30-60 cN/tex, at a temperature of 10-100° C., especially 10-50° C., advantageously approximately 20° C. This allows a high loading capacity of the planar textile material, so that it can also withstand high force-related loading ("sitting down" when used as a sitting surface).

In addition, the heat-shrinkable plastic yarn in the scope of the present disclosure should feature an elongation at break of 2-50%, especially 5-40%, advantageously 10-30%, preferred 10-20%, at a temperature of 10-100° C., especially 10-50° C., advantageously approximately 20° C. This leads to a further improvement of the stability and force-related loading capacity of the planar textile material according to the disclosure.

For realizing effective shrinkage of the planar textile material according to the disclosure under the influence of heat, the heat-shrinkable plastic yarn used according to the disclosure should feature heat shrinkage of 5-50%, especially 10-40%, advantageously 15-30%, preferred 20-25%, relative to the length of the plastic yarn in the non-shrunk state and at a temperature of 140-240° C., especially 160-200° C., advantageously approximately 180° C. In this connection, the heat-shrinkable plastic material used according to the disclosure should feature, at a lower heat-shrinkage temperature, heat shrinkage of 1-30%, especially 2-20%, advantageously 5-15%, preferred 5-10%, relative to the length in the non-shrunk state and at a temperature of 60-140° C., especially 80-120° C., advantageously approximately 100° C. Through the specific shrinkage properties of the heat-shrinkable plastic yarn, shrinkage of the planar textile material is allowed overall, so that in this way, the planar textile material can be mounted, so-to-speak through shrink fit, onto a carrier structure, for example, a carrier frame for a chair backrest or for a sitting surface, wherein, on one hand, high stability and, on the other hand, a nearly fold-free covering or lining is realized.

The heat-shrinkable plastic yarn used according to the disclosure should also feature a shrinkage force of 100-1000 cN, especially 200-900 cN, advantageously 300-800 cN, preferred 400-600 cN, at a temperature of 140-240° C., especially 160-200° C., advantageously approximately 180° C. In addition, the heat-shrinkable plastic yarn should feature a shrinkage tension of 0.5-10 cN/tex, especially 1-5 cN/tex, advantageously 1.5-4 cN/tex, preferred 2-3.5 cN/tex, at a temperature of 140-240° C., especially 160-200° C., advantageously approximately 180° C. Through the previously defined shrinkage force, it is guaranteed that the planar textile material according to the disclosure, which is mounted, for example, on a carrier structure or a frame, builds up, so to speak, a certain internal tension during the heat shrinkage and thus mounts onto the frame, wherein similarly folds or the like are pulled smooth and the planar textile material adapts optimally to the given contours of the carrier structure or the frame due to the heat shrinkage. For the use of heat-shrinkable plastic yarns with high diameter, another increased shrinkage force or shrinkage tension is produced.

As far as the amount or percentage of heat-shrinkable plastic yarn is concerned with reference to the planar textile material according to the disclosure, this can vary in wide ranges, wherein those skilled in the art is in the position at any time to select the actual amounts in front of the background of the desired shrinkage behavior and the desired textile properties. However, according to the disclosure, it is preferred that the percentage of heat-shrinkable plastic yarn equals 1-60 wt %, especially 2-50 wt %, advantageously 4-40 wt %, preferred 5-30 wt %, especially preferred 6-20 wt %, very especially preferred 8-10 wt %, relative to the planar textile material.

As far as the other yarn systems differing from the heat-shrinkable plastic yarn are concerned, these can feature, each independent of each other, yarns with a titer of 50-10,000 dtex, especially 100-5000 dtex, advantageously 200-3750 dtex, especially preferred 300-900 dtex, very especially preferred 400-800 dtex. In this respect, it can be provided that the yarn systems feature, each independent of the other, a yarn based on a type of fiber, especially textile fiber. In this respect, the type of fiber can include natural fibers, preferably wool fibers or cotton fibers (CO), preferred wool fibers, and/or chemical fibers, preferably synthetic fibers, especially selected from the group of polyesters (PES); polyolefins, especially polyethylene (PE) and/or polypropylene (PP); polyvinyl chloride (CLF); polyvinylidene chloride (CLF); acetate (CA); triacetate (CTA); polyacryl (PAN); polyamide (PA), especially aromatic, preferably flame-resistant polyamides (e.g., NOMEX®); polyvinyl alcohol (PVAL); polyurethanes; polyvinyl esters; (meth)acrylates; polylactic acids (PLA); as well as their mixtures, preferably polyamide (PA). The previously mentioned abbreviations for the textile fibers originate from DIN 6001-4 (August 1991).

For further details on the term of textile fibers, synonymously also designated as textile fiber materials, refer, for example, to Römpp Chemielexikon, Georg Thieme Verlag Stuttgart/New York, Vol. 6, 1999, pp. 4477-4479, headword: "textile fibers," whose entire contents, including the references cited there are incorporated herewith through reference. In particular, in the scope of the present disclosure, the term textile fibers is understood as a collective designation for all fibers which can be worked into textiles. The textile fibers have in common a great length relative to their cross section, as well as sufficient strength and flexibility, wherein the textile fibers can be classified into different groups according to origin and material quality.

As previously indicated, according to one especially preferred embodiment according to the disclosure, the planar textile material is constructed in the form of a textile fabric. In this respect, the planar textile material can thus be constructed as a textile fabric with a yarn system with a plurality of weft threads and a plurality of warp threads. The textile fabric according to the disclosure thus features a plurality of weft threads and a plurality of warp threads.

With respect to the especially preferred embodiment according to the disclosure, according to which the heat-shrinkable planar textile material according to the disclosure is constructed in the form of a textile fabric, it is similarly provided that the textile fabric has at least one heat-shrinkable plastic yarn. With respect to the specification of the usable heat-shrinkable plastic yarn, reference is made to the above constructions, which apply here accordingly.

As far as the actual construction of the planar textile material according to the disclosure in the form of a textile fabric is concerned, the heat-shrinkable plastic yarn can be used, in order to actually set or to so-to-speak tailor the heat-shrinkage properties.

Thus, according to a first embodiment according to the disclosure, it can be provided that the planar textile material in the form of a textile fabric has shrinking weft threads, which contain the heat-shrinkable plastic yarn. In other words, the heat-shrinkable plastic yarn is arranged in the scope of shrinking weft threads, so-to-speak only in the weft direction of the planar textile material according to the disclosure, so that for a corresponding heat-shrink treatment, shrinkage is produced at least essentially only on the weft direction of the fabric.

However, according to an alternative embodiment, it can also be provided that the planar textile material in the form of a textile fabric has shrink warp threads which contain heat-shrinkable plastic yarn. Accordingly, the heat-shrinkable plastic yarns according to this embodiment are arranged in the warp direction of the planar textile material according to the disclosure, so that for a heat-shrink treatment to be performed, shrinkage is produced at least essentially only in the warp direction of the fabric according to the disclosure.

According to another embodiment according to the disclosure, it can also be provided that the planar textile material in the form of a textile fabric has shrinking weft threads and shrinking warp threads which each contain heat-shrinkable plastic yarn. According to this embodiment, the heat-shrinkable plastic yarn is arranged both in the weft direction and also in the warp direction. Consequently, for a heat-shrink treatment, a defined shrinkage is produced both in the weft direction and also in the warp direction of the fabric according to the disclosure. Here, it can also be provided according to the disclosure to set a different shrinkage in the weft and warp directions through a different selection of the heat-shrinkable plastic yarn with respect to the weft and warp directions.

As concerns the heat shrinkage with respect to the planar textile material according to the disclosure, in particular, in the form of a fabric, due to the effect of heat, which induces a defined shortening in length associated with some increase in diameter of the heat-shrinkable plastic yarn, a shortening of the planar textile material is produced in the length and/or in the width of the planar textile material according to the disclosure or, if the planar textile material is fixed on or to a carrier structure, for example, a frame, the planar textile material is mounted. During the shrinkage process, the distance of each thread running perpendicular to the shrinkage direction is decreased relative to each other, so that the planar textile material according to the disclosure similarly "thickens" during the shrinkage process.

If the planar textile material according to the disclosure is provided in the form of a textile fabric, the planar textile material can include the heat-shrinkable plastic yarn similarly in an amount of 1-60 wt %, especially 2-50 wt %, advantageously 4-40 wt %, preferred 5-30 wt %, especially preferred 6-20 wt %, very especially preferred 8-10 wt %, relative to the textile fabric. Relative to the individual case or specific to the application it can be necessary to deviate from the amounts above, but without hereby leaving the scope of the present disclosure. Similarly, it is within the scope of the present disclosure to reduce or increase each amount of heat-shrinkable plastic yarn to be used, for example, if a plastic yarn with a smaller thickness or with a greater thickness is used.

As far as the arrangement or distribution of the heat-shrinkable plastic yarn or shrinking warp threads or shrinking weft threads is concerned, it can be provided that, in the weft direction of the planar textile material constructed as a textile fabric, every second to tenth warp thread is a shrinking weft thread and/or that in the warp direction of the textile fabric, every second to tenth warp thread is a shrinking warp thread. Consequently, it can be provided according to the disclosure that also every third, fourth, fifth, sixth, seventh, eighth, or ninth weft thread or warp thread is a shrinking weft thread or shrinking warp thread. In this respect, those skilled in the art are in the position to select the specific arrangement of the shrinking weft threads and the warp-weft threads in the heat-shrinkable planar textile material according to the disclosure in view of the background of the desired shrinkage properties including the desired textile properties.

As far as the actual construction of the shrinking weft threads or shrinking warp threads is concerned, this can consist of the heat-shrinkable plastic yarn. Similarly, however, it is also possible that the shrinking weft threads or the shrinking warp threads contain, along with the heat-shrinkable plastic yarn, additional fibers, especially as defined above.

As indicated above, compression of the thread or yarn arrangement is induced by the shrinkage process, so that, relative to the planar material according to the disclosure in the form of a fabric, the weft threads or each warp threads are pushed closer to each other by the heat-shrinkage process and thus their spacing is reduced. This phenomenon should be considered with respect to the construction of the non-shrunk planar textile material according to the disclosure, wherein in this respect a certain spacing of the weft threads or the warp threads should be maintained with respect to the non-shrunk material, so that after shrinking, preferably the threads do not overlap or are not pushed one on top of the other. In this respect, it can be provided according to the disclosure that the weft threads and/or the warp threads and/or the shrinking weft threads and/or the warp-weft threads are spaced apart to the adjacent thread by 0.1-3 times, especially by 0.2-2 times, advantageously by 0.3-1.5 times, preferred by 0.5-1 times the thread diameter, relative to the non-shrunk textile fabric. In particular, the threads running perpendicular to the shrinkage direction, as described above, are spaced apart from each other. Similarly, it lies within the scope of the disclosure if significantly higher distances are realized, for example, in connection with a mesh-like construction of the fabric. Through the shrinkage process, the given distances of the threads are reduced accordingly, that is, as a function of the shrinkage intensity or strength. In special applications, however, it can be desired or necessary (e.g., for achieving special optical or application-related effects) that a compression of the thread or yarn arrangement is induced by the shrinkage process, such that, relative to the planar material according to the disclosure in the form of a fabric, the weft threads or the warp threads are not only pushed closer to each other by the heat-shrinkage process and thus their spacing is reduced, but these are shifted or pushed one above or on top of the other by the shrinkage process, possibly several times; in such a case, there is absolutely no longer any distance of the relevant threads or yarns in the shrunk material.

Furthermore, as far as the construction of the planar textile material in the form of a textile fabric is concerned, the planar textile material can feature, in the non-shrunk state, a fiber density in the weft direction and/or in the warp direction of 1-100 threads/cm, especially 2-50 threads/cm, preferably 3-30 threads/cm. Specific to the individual case or related to the application, however, it can deviate from the above information. Through an actual selection of the fiber density, defined properties of the planar textile material can be realized. For example, it is possible to obtain a certain amount of light-proof or view-proof planar material. On the other hand, it is possible—for a smaller fiber density—to construct the fabric according to the disclosure so-to-speak with a network structure and thus to a certain extent as a network.

As far as the weft threads and/or the warp threads of the planar textile material according to the disclosure constructed as a textile fabric are concerned, these can feature, each independent of the other, yarns with a titer of 50-10,000 dtex, especially 100-5000 dtex, advantageously 200-3750 dtex, especially preferred 300-900 dtex, very especially preferred 400-800 dtex.

In this connection, the weft threads and/or the warp threads can feature, each independent of each other, a yarn on the basis of a fiber type, especially textile fibers. In this respect, reference is made to the above constructions concerning the yarn system of the planar textile material according to the disclosure, which here apply accordingly. Similarly, a construction of the fibers as mixed yarn or the use of spinning fibers is possible.

Another detail of the present disclosure is to be seen in that the planar textile material constructed as a textile fabric is constructed elastically and/or, in particular, reversibly expandable in the weft direction and/or warp direction, each independent of each other, in particular, wherein the elasticity and/or the especially reversible expandability in the weft direction and/or in the warp direction equals 5-30%, especially 10-25%, preferred 15-20%, relative to the length of the textile fabric in the non-expanded state.

Preferably, the direction of the planar textile material is equipped with the previously defined expandability, which does not provide the heat-shrinkable plastic yarn, wherein, however, the present disclosure is not limited to this embodiment. As still to be described in detail below and already mentioned above, it can be provided in this respect that the weft threads and/or the warp threads feature, each independent of each other, an elastic yarn. This is because the expansion recovery properties can be created or reinforced, especially through possibly present elastomeric or rubber threads, yarns, filaments, or the like, so that it is preferred according to the disclosure when the planar textile material according to the disclosure also features an elastomeric and/or rubber portion (e.g., rubber, natural rubber, elastomeric polymers, etc.), preferably in the form of elastomeric or rubber threads, yarns, filaments, or the like.

In this respect, it can be provided that the weft threads and/or the warp threads feature, each independent of each other, an elastic yarn, especially wherein the elastic yarn features an elastomeric thread, especially with a titer of 1-10,000 dtex, especially 1-5000 dtex, advantageously 5-4000 dtex, especially preferred 10-3500 dtex, very especially preferred 20-2500 dtex; here, the elastomeric thread can be twisted in a bonded way with at least one thread and/or yarn, especially with two threads and/or yarns. The thickness of the threads or yarns used in this respect should here each equal approximately one tenth of that of the elastomeric thread, wherein OE yarns ("open-end yarns") made from polyvinyl chloride, polyvinyl cyanide, polyacryl nitrile, and/or weft threads or yarns are used as the threads or yarns, preferably in the rotary method. For additional constructions in this respect, reference is made to EP 0 036 948 A1, whose entire contents are herewith incorporated through reference. The elastomeric thread can be used with other threads or yarns in the form of a covered yarn or a twisted yarn.

As previously indicated, however, the present disclosure is not limited to an embodiment, according to which the planar textile material according to the disclosure is constructed like a type of fabric. Similarly, the present disclosure also includes embodiments, according to which the planar textile material according to the disclosure is constructed in the form of a knit fabric, stitched fabric, structure, or textile composite, especially in the form of a non-woven material. Here, within the scope of the present disclosure, a knit fabric preferably involves a so-called stitch product, which includes yarn systems built according to the so-called warp-thread technique. A characteristic feature for stitch products is that they, in contrast to fabrics consisting of warp and weft, are produced by stitch formation. The central or weave element of a stitch product and, thus, of a warp knit product is the stitch, which consists of a stitch head, two stitch legs, and two stitch feet. In this respect, the planar textile material according to the disclosure in the form of a knit fabric can include various basics, such as fringes, tricot fabrics, cloths, satin, velvet, as well as sateen. A characteristic feature for the planar textile material according to the disclosure in the form of a knit fabric is the fact that the planar textile material according to the disclosure also features in this respect at least one heat-shrinkable plastic yarn, which is worked into the knit fabric or is a component of the lapping, so that the heat-shrinkable plastic yarn can also be incorporated in the stitch formation. In addition, the heat-shrinkable plastic yarn can also be worked in the form of other weave elements into the knit fabric according to the disclosure, such as, weft, vertical threads, loop, and/or float stitches. Those skilled in the art are in the position at any time to select both the actual construction and also the amount of heat-shrinkable plastic yarn in the knit fabric according to the disclosure, in order to obtain the properties desired in terms of the shrinkage behavior.

Similarly, the heat-shrinkable plastic yarn can be used in the scope of heat-shrinkable stitched fabrics according to the disclosure. This also applies for non-woven materials, which generally feature a fiber mat. In such materials, the heat-shrinkable plastic yarn can be formed, for example, in the form of weft threads or the like.

As far as the actual heat shrinking of the planar textile material according to the disclosure is concerned, this can be realized by a corresponding temperature treatment, wherein the temperature level and duration with respect to the corresponding temperature treatment should be performed as a function of the desired shrinkage behavior and under consideration of the materials that are used. In general, the heat shrinkage should be performed at temperatures of 60-200° C., especially 80-150° C., advantageously 90-140° C., preferred 100-130° C. In particular, the planar textile material according to the disclosure should be fixed in advance to a carrier structure, for example, a frame.

The planar textile material according to the disclosure thus can be heat shrunk, wherein in this respect the heat shrinking should be performed, in particular, under the temperatures mentioned above.

Accordingly, another subject matter of the present disclosure, according to a second aspect according to the disclosure, is a heat-shrunk planar textile material, especially in the form of a textile fabric, with a plurality of yarn systems forming the planar material, especially with a plurality of warp threads and a plurality of weft threads. The heat-shrunk planar textile material according to the disclosure, which is present, in particular, in the form of a heat-shrunk textile fabric, is distinguished in that it features at least one heat-shrinkable plastic yarn, wherein the planar textile material, especially in the form of a textile fabric, has become heat-shrunk.

For example, the heat-shrunk planar textile material can be produced from the non-shrunk planar textile material described above according to the disclosure, wherein, in this respect, in particular a shrinkage heat treatment has been performed. The heat treatment in this respect is selected with respect to the shrinkage conditions with reference to temperature and time duration, such that the desired shrinkage of the planar textile material is obtained. Those skilled in the art is in the position at any time to select the corresponding shrinkage conditions, for example, with respect to the shrinkage temperature and the shrinkage duration, as a function of the desired shrinkage as well as the material to be shrunk. In this respect, the heat-shrunk planar textile material according to the disclosure can be heat shrunk, as previously indicated, at temperatures of 60-200° C., especially 80-150° C., advantageously 90-140° C., preferred 100-130° C.

The heat-shrunk planar textile material according to the disclosure can be shrunk, for example, by 1-50%, especially 2-40%, advantageously 3-30%, preferred 4-20%, especially preferred 5-15%, very especially preferred 5-10%, relative to the length and/or width in the non-shrunk state.

With respect to the shrunk planar textile material according to the disclosure, the planar material is also, in particular, compressed due to the specific shrink treatment. Accordingly, for example, with reference to the construction of the shrunk planar textile material according to the disclosure as a shrunk fabric, the weft threads and/or the warp threads and/or the shrinking weft threads and/or the warp-weft threads feature a spacing reduced by the shrinkage to each adjacent thread compared with the non-shrunk fabric. For example, the threads, in a non-limiting way with reference to the shrunk fabric, for a shrinkage of 10%, are spaced apart from each other by approximately 1.8 times the thread diameter, if the original spacing, with reference to the non-shrunk fabric, equals 2 times the thread diameter. In general, the weft threads and/or the warp threads and/or the shrinking weft threads and/or the warp-weft threads are spaced apart from each adjacent thread with reference to the shrunk fabric according to the disclosure by 0.05 times to approximately 3 times the thread diameter, with reference to the shrunk textile fabric and with reference to the threads running perpendicular to the shrinkage direction. Similarly, it lies within the scope of the present disclosure if it deviates from the values mentioned above. Here, in the scope of the present disclosure it is possible, in particular, to construct the shrunk textile fabric according to the disclosure, for example, in the form of a mesh with large thread spacing. For example, the weft threads and/or the warp threads and/or the shrinking weft threads and/or the warp-weft threads could also be spaced apart from each other by 5 times, 10 times, or more according to the above definition. In general, the spacing of each thread with respect to the shrunk planar textile material is constructed in that the threads are prevented from overlapping or being placed one above the other during the shrinkage, in order to prevent this irregular or wavy or "crimped" structuring of the planar textile material according to the disclosure in the shrunk state.

However, as already mentioned before, according to the disclosure, it can be desired or necessary, nevertheless, for special applications (e.g., for achieving special optical or application-related effects) that a compression of the thread or yarn arrangement is induced by the shrinkage process, such that the threads or yarns, in particular the weft threads and/or the warp threads in the case of a fabric, are shifted or pushed one above the other or one onto the other by the heat-shrink process. In this way, after the heat-shrink process, for example, crimped and/or so-to-speak wavy textile planar structures are produced.

Similarly, the shrunk planar textile material according to the disclosure, in particular, the shrunk textile fabric, features increased fiber density in the weft direction and/or in the warp direction compared with the non-shrunk state, because the threads lie closer to each other with smaller spacing due to the shrinkage process so-to-speak in the shrinkage direction. For example, the heat-shrunk textile fabric according to the disclosure can have, for example, starting with a non-shrunk fabric according to the disclosure with a thread density of 12 threads/cm, a thread density of 15 threads/cm after successful heat shrinkage.

As far as the shrinkage values with respect to the heat-shrunk planar textile material according to the disclosure is concerned, these can vary in large ranges and can be set individually by selecting the parameters of the shrinkage process. In general, however, it is provided that the heat-shrunk planar textile material according to the disclosure is to be shrunk by 1-50%, especially 2-40%, advantageously 3-30%, preferred 4-20%, especially preferred 5-15%, very especially preferred 5-10%, relative to the length and/or width in the non-shrunk state—that is, relative to the non-shrunk planar textile material according to the disclosure. Through the individual setting of the shrinkage, a plurality of differently shaped planar textile materials according to the disclosure can be realized, whose product properties are optimized or tailored with respect to the field of application or field of use. Thus, a high shrinkage can be set, e.g., when the planar textile material according to the disclosure is to line a carrier with pronounced shaping.

The heat-shrunk planar textile material according to the disclosure, which is present, in particular, in the form of a textile fabric, is further distinguished in that the heat-shrunk planar textile material features a slip resistance (non-slip strength), especially seam slip resistance (seam non-slip strength), particularly with respect to the warp direction or weft direction and according to DIN 53868, of at least 50 N, especially at least 100 N, advantageously at least 150 N, preferred at least 200 N, especially preferred at least 300 N. Due to the high slip resistance (non-slip strength), especially seam slip resistance (seam non-slip strength), the heat-shrunk planar textile material according to the disclosure features high stability or resistance relative to transverse loads on the threads, so that for a force loading perpendicular to the alignment or to the longitudinal direction of the thread, there is at least essentially no shifting of the threads perpendicular to its longitudinal direction. Through the high slip resistance (non-slip strength), especially seam slip resistance (seam non-slip strength), as previously described, mesh-like structures with large thread spacing with respect to the heat-shrunk planar textile material, especially the heat-shrunk textile fabric according to the disclosure, can also be realized.

Furthermore, the heat-shrunk planar textile material is distinguished by high tensile strength: for example, the heat-shrunk planar textile material according to the disclosure features a tensile strength, especially with respect to the warp direction or weft direction and according to EN ISO 13934-1, of at least 300 N, especially at least 400 N, advantageously at least 600 N, preferred at least 800 N. In this way, high force-related loads can be realized, for example, when the heat-shrunk planar textile material according to the disclosure is used in the scope of a seat backrest or a seat part.

In addition, the heat-shrunk planar textile material according to the disclosure is distinguished by a high tear strength: for example, the heat-shrunk planar textile material can feature a tear strength, especially relative to the weft direction and according to EN ISO 13937-3 of at least 30 N, especially at least 40 N, advantageously at least 60 N, preferred at least 80 N. As far as the term "tear strength" is concerned, in the scope of the present disclosure this relates especially to the tear response of the heat-shrunk planar textile material according to the disclosure, especially cuts, tears, notches, or the like, like those that can appear, for example, due to excessive mechanical loading. The higher the tear strength or resistance to tear propagation, the greater the force that must be applied to cause propagation of the cut, tear, or the like.

Overall, the heat-shrunk planar textile material according to the disclosure features excellent mechanical properties, wherein it is especially suitable for applications in which high force-related loads appear, for example, in the furniture industry in the field of seating furniture or the like.

The planar textile material according to the disclosure, especially the textile fabric, especially as defined above, with respect to the non-shrunk planar textile material or the non-shrunk textile fabric according to the disclosure, is suitable for use for generating a heat-shrunk planar textile material according to the disclosure, especially a heat-shrunk textile fabric, especially as defined above with respect to the shrunk planar textile material according to the disclosure, especially the heat-shrunk textile fabric according to the disclosure.

In this respect, for obtaining the heat-shrunk planar textile material according to the disclosure, the non-shrunk planar textile material according to the disclosure can be heat shrunk under the already described heat-shrink conditions, preferably after placement on a carrier or frame.

In addition, the planar textile material, especially the textile fabric, as defined above, is suitable for a method for producing a heat-shrunk planar textile material according to the disclosure, especially a heat-shrunk textile fabric, as defined above, wherein the planar textile material, especially the textile fabric, as defined above, is shrunk by means of a heat treatment. With respect to actual parameters in terms of the heat treatment to be performed, reference is made to the above descriptions.

As far as the production of the heat-shrinkable planar textile material according to the disclosure is concerned as such, this is known to those skilled in the art. With respect to the especially preferred embodiment according to the disclosure, according to which the heat-shrinkable planar textile material according to the disclosure is constructed like a type of fabric, the fabric can be produced under the use of typical weaving techniques on commercially available weaving machines, which feature, for forming a certain thread density, a specific reed, synonymously also designated as weaving comb or weaving reed. Here, it is possible that several threads are placed in each reed holder. For example, a 40 reed can be used, which is set with three threads for each reed holder. According to the desired percentage or desired amount of heat-shrinkable plastic yarn, in this respect a defined number of threads are formed by the heat-shrinkable plastic yarn (for example, two conventional yarns and one heat-shrinkable plastic yarn for each reed holder). In such a configuration, a heat-shrinkable planar textile material according to the disclosure is produced with a thread strength of 120 threads/10 cm. Similarly, however, a so-called 50 reed can also be used, wherein then, for an assignment of the reed holders each with three threads, a heat-shrinkable planar textile material according to the disclosure is produced with a thread strength of 150 threads/10 cm. When assigning the reed holders of the 50 reed with only two threads or yarns, a heat-shrinkable planar textile material according to the disclosure is produced with a thread density of 100 threads/10 cm.

In this connection, the production of the planar textile material according to the disclosure is known according to the embodiment, according to which the heat-shrinkable textile material according to the disclosure is constructed as a knit fabric, stitched fabric, or textile composite, the production in this respect is also known to those skilled in the art. The provision of the planar textile material with at least one heat-shrinkable plastic yarn is here realized in view of the background of the desired material properties, for example, with respect to the desired shrinkage, and those skilled in the art are in the position at any time to select the related amounts as well as the type of processing, for example in the form of float stitching or the like with respect to knit fabric, so that, in this respect, no further explanation is needed.

Furthermore, the heat-shrinkable planar textile material according to the disclosure, in particular, the heat-shrinkable textile fabric according to the disclosure, as defined above, and/or the heat-shrinkable planar textile material according to the disclosure, especially the heat-shrunk textile fabric according to the disclosure, as defined above, is suitable for use in the field of the furniture industry, automotive industry, and the like. In principle, the planar textile materials according to the disclosure can be used for the purpose of interior shaping to a certain extent as the interior or as interior components, as well as for the purpose of exterior shaping to a certain extent as an exterior or as exterior components. For example, the planar textile materials according to the disclosure, especially the textile fabric according to the disclosure, are suitable for production or use as linings of carrier structures or elements, such as carrier frames or the like.

Accordingly, the heat-shrinkable planar textile material according to the disclosure, especially the heat-shrinkable textile fabric according to the disclosure, as defined above, or the heat-shrunk planar textile material according to the disclosure, especially the heat-shrunk textile fabric according to the disclosure, as defined above, is suitable for use for producing furniture elements, especially seating furniture elements, preferably backrests and/or seat parts, decorative elements, hollow channels, automotive accessories, and the like.

In the scope of the present disclosure, the term "seating furniture" is to be understood very broadly: for example, the term "seating furniture" relates to seating objects or seating elements of all kinds, as examples and not in a limiting way: chairs, lounge chairs, loungers, armchairs, sofas, benches, couch sets, stools, and the like, the seating furniture can be constructed so that it features heat-shrinkable or heat-shrunk planar textile material according to the disclosure.

The planar textile material according to the disclosure here can be fixed to a carrier structure, which can be constructed, as examples and not in a limiting way, in the form of a frame, on which the planar textile material according to the disclosure, preferably in the heat-shrunk form, is mounted. Such units can then form, for example, the sitting surface and/or the backrest of a chair or the like. Similarly, the planar textile material according to the disclosure can be used for lounge chairs or loungers.

The basic principle consists in that, initially, the heat-shrinkable planar textile material according to the disclosure is fixed or mounted on a carrier. Here, the carrier should preferably be arranged at the edge regions of the heat-shrinkable planar textile material according to the disclosure, or the heat-shrinkable planar textile material according to the disclosure should be fixed at its edges to the carrier. The carrier can involve, as mentioned above, for example, a frame or the like. In this respect, the carrier can be constructed such that the planar textile material according to the disclosure is fixed at all of the edges to the carrier. Similarly, however, it lies within the scope of the present disclosure when, for example, only the opposing edges of the planar textile material according to the disclosure are mounted to the carrier. The carrier, however, can also be solid, e.g., like a type of plate, wherein, if necessary, between the carrier and planar material, other layers, such as foam, can be inserted. Through the heat shrinking, the planar textile material according to the disclosure is so-to-speak mounted onto the carrier structure, wherein any folds or the like are so-to-speak pulled smooth by the resulting tensile load.

Another subject matter of the present disclosure, according to a third aspect of the present disclosure, is also the method for producing furniture elements, especially seating furniture elements, preferably backrests and/or seat elements, decorative elements, hollow channels, automotive accessories, and the like, wherein the heat-shrinkable planar textile material according to the disclosure, especially the heat-shrinkable fabric, as defined above, is mounted on a carrier, especially a frame, and then the heat-shrinkable planar textile material, especially the heat-shrinkable textile fabric, is heat shrunk, so that an at least essentially fold-free, reversibly expandable covering, preferably under internal tension, is produced for the carrier or frame with the heat-shrunk planar textile material according to the disclosure, especially with the heat-shrunk textile fabric according to the disclosure, as defined above.

The covering is preferably constructed so that the mounted and preferably heat-shrunk planar textile material is not lined underneath or has no additional support layer, for example, in the form of foam or the like. As indicated above, however, the present disclosure is not limited to this construction, and it similarly lies within the scope of the present disclosure that the covered planar textile material according to the disclosure is lined underneath, for example, with a sitting cushion or the like.

A decisive advantage of the method according to the disclosure is to be seen in that the carrier or frame structure is covered with the not-yet heat-shrunk and thus heat-shrinkable planar textile material according to the disclosure and the heat shrinkage is performed as a subsequent step. This eliminates, so-to-speak, exact biasing of the frame structure and, with respect to the blank of the heat-shrinkable planar textile material, larger tolerances can be used, which leads to simplification in terms of production with simultaneous cost reduction. Complicated covering, for example, "diagonal cross over," is eliminated. In the scope of the production of furniture elements, such as seating furniture elements, initially, for example, the frame can be covered with the heat-shrinkable planar textile material according to the disclosure, then heat shrinking is performed, and then each frame element with the heat-shrunk planar textile material is further processed to form the final product, for example, a chair, especially including additional components.

Finally, the present disclosure, according to a fourth aspect of the present disclosure, relates to furniture elements, especially seating furniture elements, preferably backrests and/or seat parts, decorative elements, hollow channels, automotive accessories, and the like as those, which have at least one planar textile material according to the disclosure, especially a textile fabric, as defined above, and/or which have at least one heat-shrunk planar textile material, especially a heat-shrunk textile fabric, as defined above.

In the scope of the present disclosure, overall a capable and flexibly adaptable, heat-shrinkable planar textile material is produced, which is suitable due to its variability to the given requirements for numerous fields of use. In addition, for example, through the use of special yarns, the material properties of the planar textile material according to the disclosure can be further improved or adapted individually, for example, in terms of its tear strength or expansion loading. In this connection, the heat shrinkability can also be adapted with respect to the appropriate requirements. For example, it is possible to construct the heat-shrinkable planar textile material according to the disclosure to be heat-shrinkable only in one direction, for example, only in the weft direction, which is then advantageous, for example, when the planar textile material is fixed on a carrier or frame at only two opposing edge regions. Another significant advantage of the present disclosure consists in that, in terms of covering carriers, exact blanks and sewing with respect to the planar textile material according to the disclosure are not necessary, because any folds and the like are pulled smooth by the following heat-shrink process.

Other advantageous properties, aspects, and features of the present disclosure result from the following description of embodiments shown in the figures.

BRIEF SUMMARY

A heat-shrinkable planar textile material with a plurality of yarn systems forming the planar textile material, wherein the planar textile material having at least one heat-shrinkable plastic yarn. The planar textile material according to the disclosure is suitable for producing furniture elements, especially seating furniture elements, preferably backrests and/or seat elements, decorative elements, hollow channels, automotive accessories, and the like, wherein the heat-shrinkable planar textile material can be mounted on a carrier structure and then heat shrunk.

One object of the present disclosure is to describe an improved textile material.

DETAILED DESCRIPTION

Figure 1:
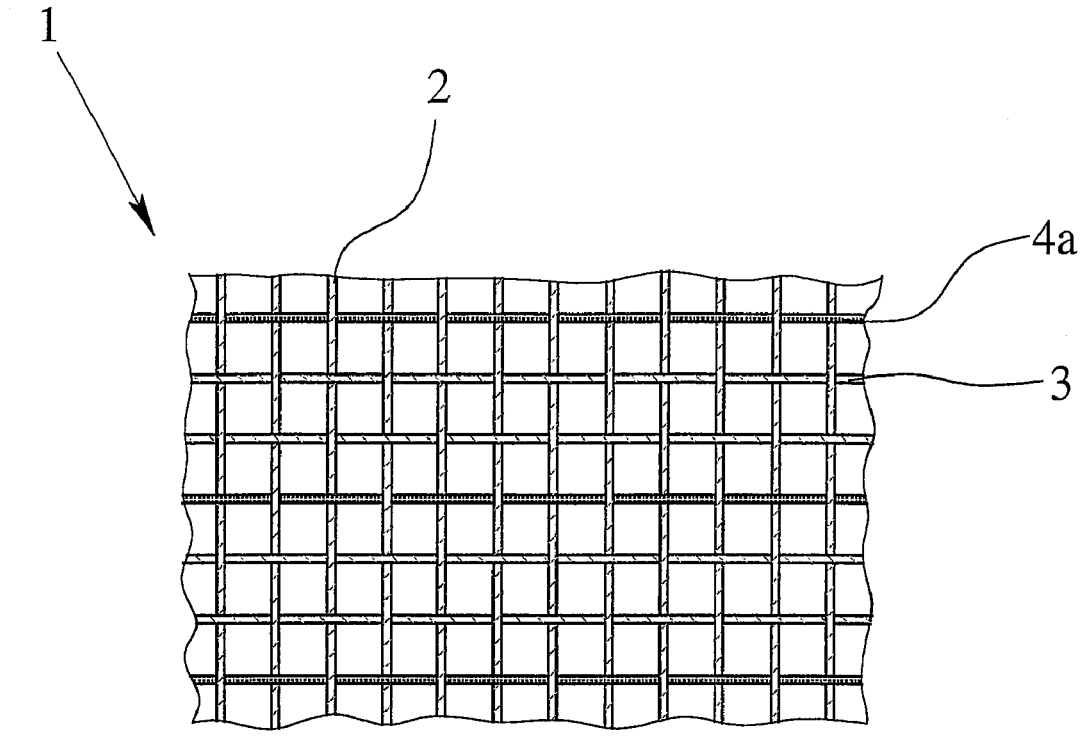
FIG. 1 is a schematic view of a planar textile material according to the disclosure.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Figure 2:
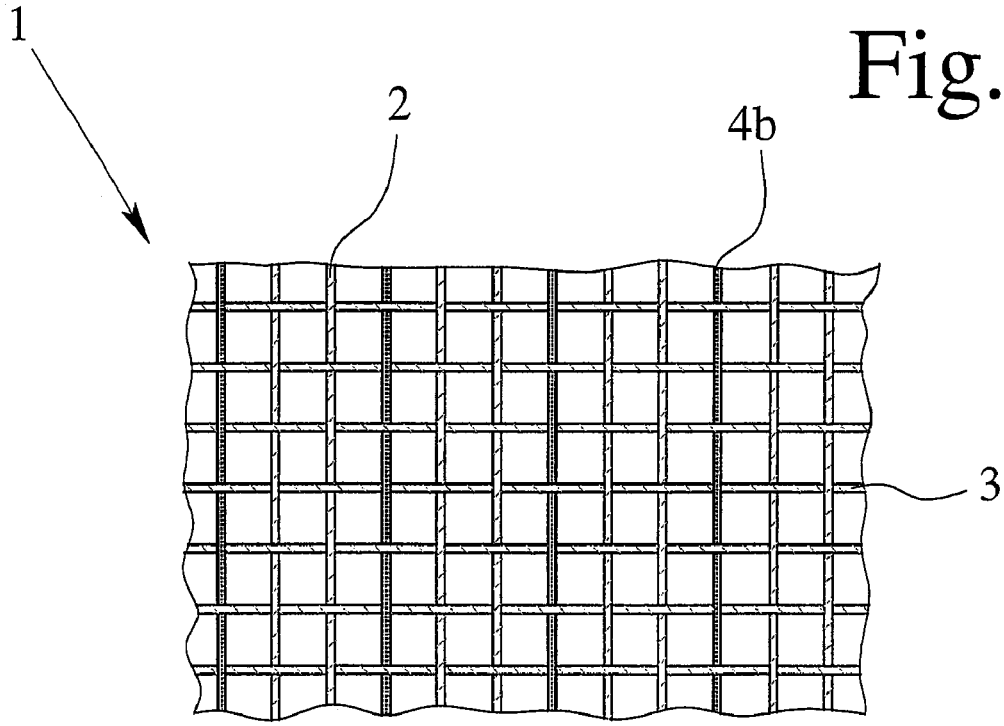
FIG. 2 is a schematic view of the planar textile material according to the disclosure according to another embodiment according to the disclosure.
Figure 3:
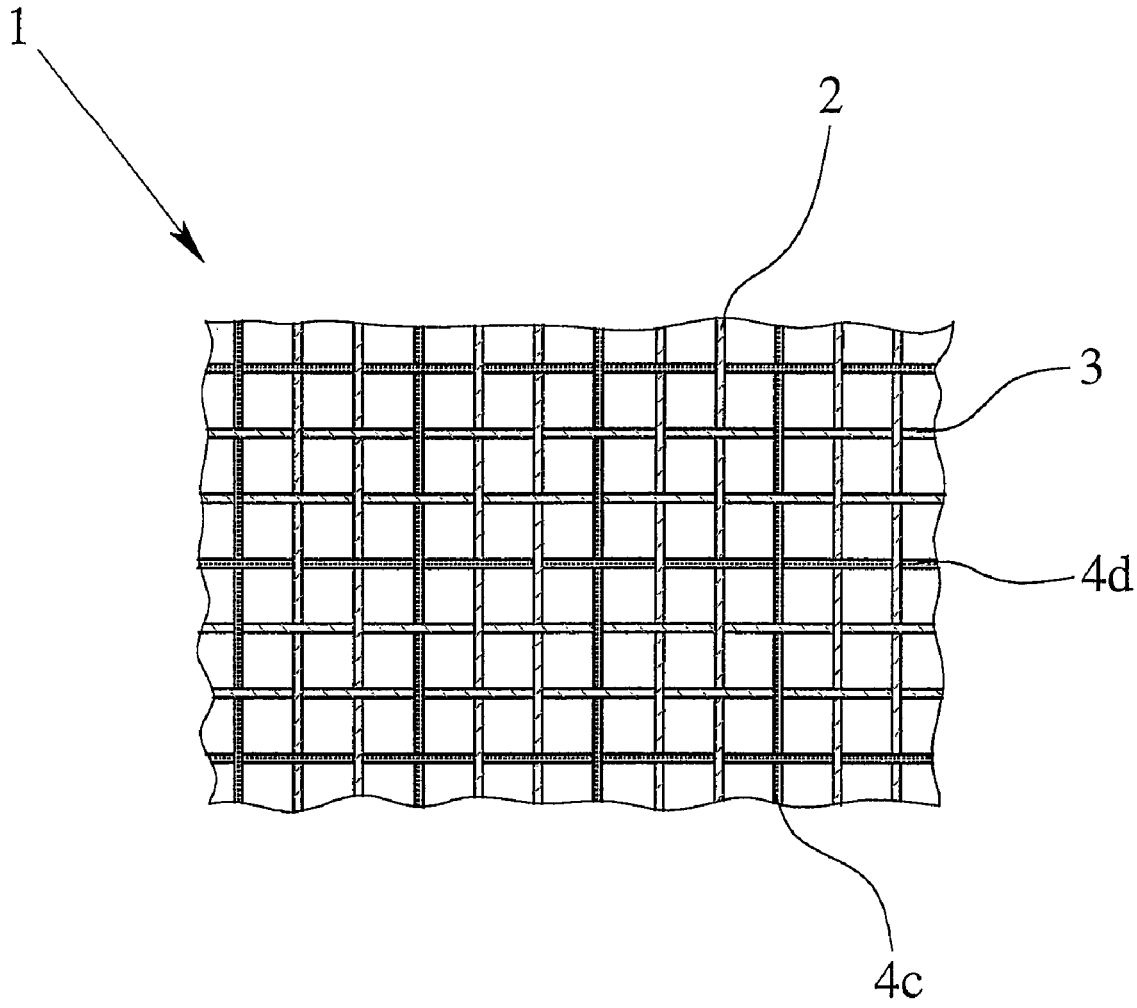
FIG. 3 is a schematic view of the planar textile material according to the disclosure according to yet another embodiment of the present disclosure.

FIGS. 1-3 show a preferred embodiment according to the disclosure, according to which the planar textile material 1 according to the disclosure is constructed in the form of a textile fabric, wherein the textile fabric has yarn systems 2, 3 with a plurality of weft threads 2 and a plurality of warp threads 3.

FIG. 1 shows a planar textile material 1 according to the disclosure with a plurality of yarn systems 2, 3 forming the planar textile material 1. The planar textile material 1 according to the disclosure is distinguished in that it features at least one heat-shrinkable plastic yarn 4*a*.

As to be further taken from FIG. 1, the planar textile material features shrinking weft threads 4*a*, which contain the heat-shrinkable plastic yarn. According to this embodiment according to the disclosure, the heat-shrinkable textile fabric according to the disclosure is provided so that it is heat-shrinkable in the weft direction. For a corresponding heat-shrink process, a shortening or a reduction of the length of the heat-shrinkable textile fabric according to the disclosure is produced in the weft direction, wherein, especially the distance of the warp threads 2 to each other is reduced.

Another embodiment according to the disclosure is to be taken from FIG. 2, according to which the heat-shrinkable planar textile material 1 constructed as heat-shrinkable fabric according to the disclosure features shrinking warp threads 4*b*, which contain the heat-shrinkable plastic yarn. According to this embodiment, the planar textile material 1 according to the disclosure in the form of a fabric is thus heat-shrinkable with respect to the warp direction, wherein, in this case, for a corresponding heat-shrink treatment, the distance of the weft threads 3 is reduced and the fabric shrinks in the warp direction.

Finally, FIG. 3 shows another embodiment according to the disclosure, according to which the planar textile material 1 according to the disclosure in the form of a textile fabric has both shrinking weft threads 4*c* and shrinking warp threads 4*d*, which each contain the heat-shrinkable plastic yarn. According to this embodiment, the planar textile material according to the disclosure has shrinking properties in both the warp and also weft directions.

Other constructions, modifications, and variations of the present disclosure can be recognized and realized easily by those skilled in the art when reading the description, without leaving the scope of the present disclosure.

While the preferred embodiment of the disclosure has been illustrated and described in the drawings and foregoing description, the same is to be considered as illustrative and not restrictive in character, it being understood that all changes and modifications that come within the spirit of the disclosure are desired to be protected.

The invention claimed is:

1. A planar textile material in the form of a textile fabric with a plurality of yarn systems forming the planar textile material, the planar textile material in the form of the textile fabric comprising a plurality of weft threads and a plurality of warp threads, wherein the planar textile material comprises:

1 to 60 wt % , relative to the planar textile material, of at least one heat-shrinkable plastic yarn, the heat shrinkable plastic yarn having a titer of 100 to 3,000 dtex, a tenacity of 10 to 120 cN/tex, at a temperature of 10 to 100 degrees C., a heat-shrinkage of 5 to 50%, relative to the length of the plastic yarn in the non-shrunk state and at a temperature of 140 to 240 degrees C., a shrinkage force of 100 to 1,000 cN, at a temperature of 140 to 240 degrees C., a shrinkage tension of 0.5 to 10 cN/tex, at a temperature of 140 to 240 degrees C.; and wherein the planar textile material further comprises at least 5 wt%, relative to the planar textile material, of an elastomeric or rubber portion in the form of elastomeric or rubber threads, yarns, or filaments.

2. The planar textile material according to claim 1, wherein the heat-shrinkable plastic yarn is constructed as a monofilament.

3. The planar textile material according to claim 1, wherein the heat-shrinkable plastic yarn having a diameter of 0.05 to 1 mm in a non-shrunk state.

4. The planar textile material according to claim 1, wherein the heat-shrinkable plastic yam features a polyester based on phthalate.

5. The planar textile material according to claim 1, wherein the heat-shrinkable plastic yarn features heat shrinkage of 1 to 30% relative to the length in the non-shrunk state and at a temperature of 60 to 140° C.

6. The planar textile material according to claim 1, wherein the planar textile material is formed as a textile fabric with yarn systems with a plurality of weft threads and a plurality of warp threads, wherein the planar textile material in the form of a textile fabric has shrinking weft threads, which contain the heat-shrinkable plastic yarn.

7. The planar textile material according to claim 1, wherein the planar textile material is formed as a textile fabric with yarn systems with a plurality of weft threads and a plurality of warp threads, wherein the planar textile material in the form of a textile fabric has shrinking warp threads, which contain the heat-shrinkable plastic yarn.

8. The planar textile material according to claim 1, wherein the planar textile material is formed as a textile fabric with yarn systems with a plurality of weft threads and a plurality of warp threads, wherein the planar textile material in the form of a textile fabric has shrinking weft threads and shrinking warp threads, which each contain heat-shrinkable plastic yarn.

* * * * *